United States Patent [19]

Christensen

[11] 4,304,025

[45] Dec. 8, 1981

[54] ROLLER APPLICATOR HANDLE

[76] Inventor: Walter C. Christensen, 704 Chestnut St., Neenah, Wis. 54956

[21] Appl. No.: 159,845

[22] Filed: Jun. 16, 1980

[51] Int. Cl.[3] ..... B05C 17/02

[52] U.S. Cl. ..... 15/230.11; 15/143 R

[58] Field of Search ..... 15/143 R, 230.11

[56] References Cited

U.S. PATENT DOCUMENTS

| | | | |
|---|---|---|---|
| 2,680,318 | 6/1954 | Simmons | 15/230.11 |
| 2,817,107 | 12/1957 | Zellinger | 15/230.11 X |
| 3,357,035 | 12/1967 | Ficke | 15/230.11 X |
| 3,408,676 | 11/1968 | Cayo | 15/230.11 |
| 3,419,931 | 1/1969 | Willig | 15/230.11 X |
| 3,520,628 | 7/1970 | Moceri | 15/230.11 X |
| 3,662,422 | 5/1972 | Christensen et al. | 15/230.11 |
| 3,866,257 | 2/1975 | Cansdale, Sr. | 15/230.11 |
| 4,038,716 | 8/1977 | Polsfuss | 15/230.11 |
| 4,089,082 | 5/1978 | McGrew | 15/230.11 |
| 4,274,174 | 6/1981 | Ertel | 15/143 R |

FOREIGN PATENT DOCUMENTS

| | | | |
|---|---|---|---|
| 555814 | 4/1958 | Canada | 15/230.11 |

*Primary Examiner*—Robert L. Bleutge
*Attorney, Agent, or Firm*—Russell I. Johnson

[57] ABSTRACT

A handle for a roller applicator. The handle is of heavy rod stock which, for the purpose of this invention, is substantially rigid. The rod is bent so that the roller may be operated with the axis of the roller vertical at locations above or below the locations which may ordinarily be painted with horizontal strokes by a person standing on the floor or ground. The longitudinal axis of the grip portion of the handle is skewed to the rotational axis of the roller at an angle in the order of 30° and the common perpendicular between the two axes is longer than two inches and the point of intersection between the common perpendicular and the axis of rotation of the roller is near to the point where the handle enters the roller.

4 Claims, 10 Drawing Figures

FIGURE 6
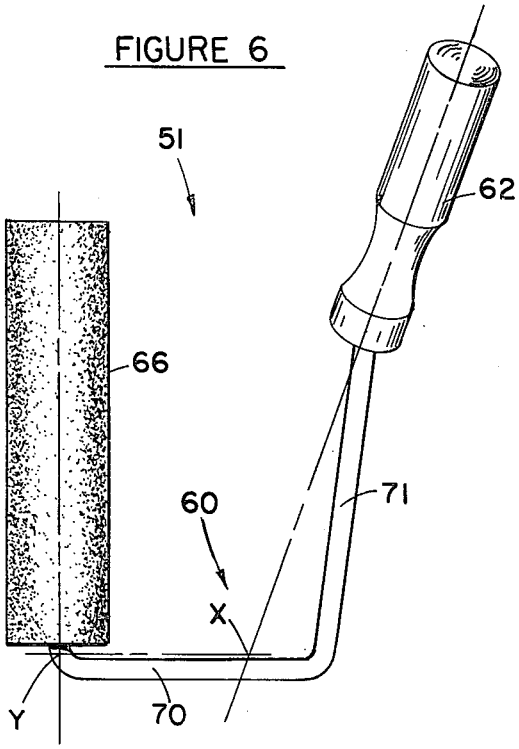
FIGURE 5
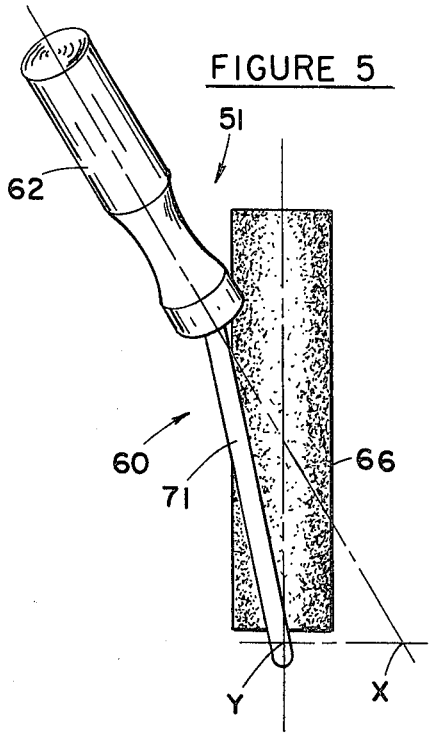
FIGURE 7
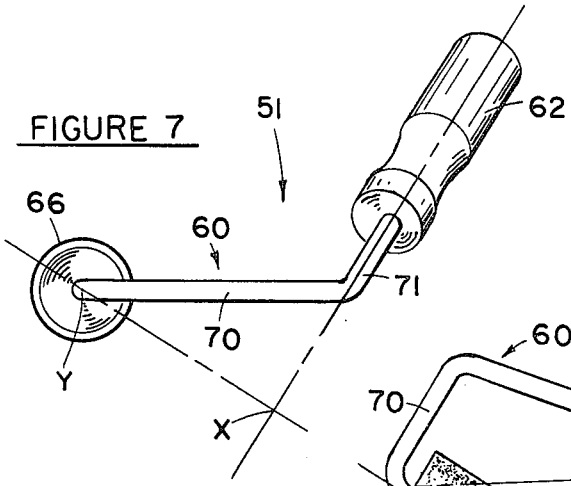
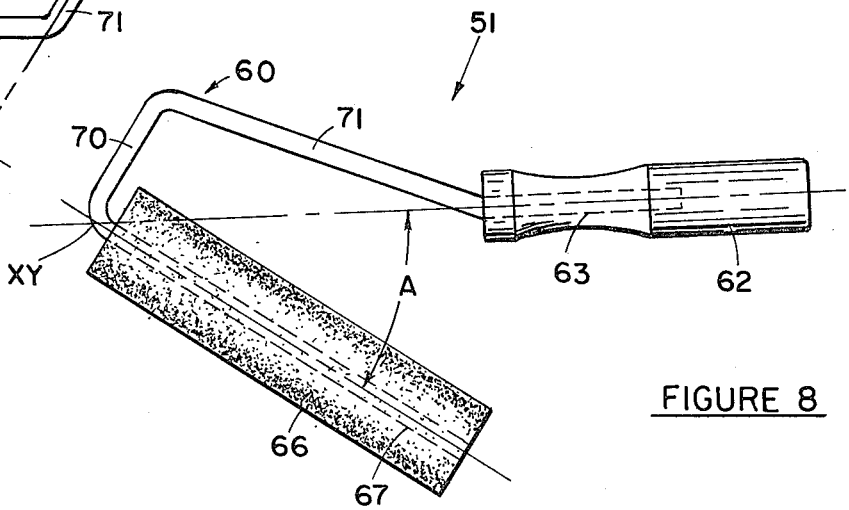
FIGURE 8

ROLLER APPLICATOR HANDLE

BACKGROUND OF THE INVENTION

Roller applicators have greatly reduced the time required to paint broad surfaces such as walls and the like. However, the painting of walls above the point at which a painter can comfortably reach while standing on the floor or ground still requires the erecting of scaffolding or platforms.

The conventional paint roll has the grip in the same plane as the axis of the roller, and the axis of the grip intersects the axis of the roller at right angles near the midpoint of the roller. Therefore, the pushing and pulling forces of the user are directed through the axis of the roller at right angles to the axis. The strokes taken by the user are usually horizontal with the elbow and wrist flexing so as to permit the use of a uniform substantially horizontal stroke.

When painting near the floor or ceiling it is desirable to paint with strokes which are horizontal. In order for a painter to stroke horizontally near the ceiling it is customary for him to stand on a platform or scaffolding. In order for the painter to stroke horizontally near the floor it is customary for him to squat or kneel to position himself so that he can stroke horizontally.

It is therefore an object of this invention to provide a handle for a roller applicator which enables a standing user to stroke horizontally above and below the areas he would ordinarily be able to cover with horizontal strokes while standing.

It is further an object of this invention to provide a handle as described above wherein the handle is made from a single piece of substantially rigid rod material.

It is further an object of this invention to provide a handle as described above wherein the balance of the roller and handle combined makes the unit readily manipulatable.

It is further an object of this invention to provide a handle as described above wherein the shape of the handle permits the user to apply uniform pressure to the roller and against the wall when the roller is in the vertical position at locations above the head or below the knees of the user.

It is further an object of this invention to provide a handle as described above wherein the shape of the handle permits the user to comfortably roll the roller with horizontal strokes in the manner described above.

Other objects of this invention will be made apparent by the following descriptions, drawings and the appended claims.

DISCUSSION OF THE PRIOR ART

The prior art has an abundance of patents which teach roller applicator handles which extend the reach of the user. The prior art also has an abundance of patents which teach roller applicator handles which provide means for adjusting the relationship between the longitudinal axis of the grip and the axis of rotation of the roller. The prior art also has patents which teach the use of special rollers, pads, and brushes for use with specially designed handles to enable the user to use the roller applicator to reach or better enable him to paint difficult areas.

To date none of these prior art devices have met with significant commercial success or wide acceptance in the painting art.

Many of the prior art devices seem to address themselves to real problems which are well known in the art.

The problem of reaching areas which are too high to be reached comfortably by a man using a conventional roller and standing on the floor is usually approached by means similar to these taught by Ficke in U.S. Pat. No. 3,357,035, by Willig in U.S. Pat. No. 3,419,931 and by Consdale in U.S. Pat. No. 3,866,257. These patents all provide handle extensions and some degree of adjustment of the handle to roller relationship. Prior art devices of the type represented by these patents are awkward to use in that the length of handle makes it difficult to maintain even pressure on the roller. Horizontal strokes with devices such as these are particularly difficult to execute. It should be noted however that many prior art conventional roller handles are provided with means for attaching a "broom handle". These handle extensions serve well enough for executing vertical strokes in situations where a first class job is not required. For other situations it has been found that except for isolated special cases that the use of an extension to the roller handle places the painter too far from the surface to be painted and these extensions are more bother than the benefits justify.

A second group of prior art patents address themselves to the problems related to the relationship between the grip and the axis of rotation of the roller. Polsfuss in U.S. Pat. No. 4,038,716; Zellinger in U.S. Pat. No. 2,817,107; McGrew in U.S. Pat. No. 4,089,082; and Cayo in U.S. Pat. No. 3,408,676 all teach roller handles in which the angular relationship of the handle with the roller is adjustable. These patents recognize the need to provide an altered relationship between the longitudinal axis of the grip and the axis of rotation of the roller. It has been found that once a satisfactory angular relationship between the grip and the roller has been established, the user will not wish to lose the relationship by adjusting the handle to facilitate another mode of use. Therefore, the adjustment attribute of the above cited references will serve primarily to permit the user to find his preferred relationship between the grip and the roller and thereafter the adjustment is of little future utility. It has also been found that the preferred relationship between the longitudinal axis of the grip and the axis of rotation of the roller is that of skewed lines. That is, they are nonparallel and nonintersecting. Therefore, adjustable handles such as those above which maintain the longitudinal axis of the grip in the same plane as that of the axis of rotation of the roller are not likely to find a position which will comfortably permit the use of a horizontal roller stroke above the head or below the knees of the user. It has further been noted that once a proper handle to roller relationship has been established, the user requires some practice to get "used to using" the new configuration. In this respect it is reasonable to suppose that if the painter cannot effectively use the new handle configuration after a brief period of experimentation, he will discard the new device and return to his customary methods.

A third group of patents provide special rollers and special handles for painting difficult to reach locations or for doing special jobs. U.S. Pat. No. 3,662,422 to Christensen, U.S. Pat. No. 3,520,628 to Moceri and U.S. Pat. No. 2,680,318 to Simmons are patents which teach the use of special rollers. These rollers may work very well for their specialized purposes. However, they serve as a counter example for the instant invention in that the instant invention uses a conventional roller or roller sleeve to paint the broad surfaces of walls. A commercial painter has little patience with the cleaning and maintenance of specialized tools for small special application. He, therefore will at every opportunity elect to get the job done with a minimum number of and variety of implements.

It can be seen from the plethora of prior art patents which have attempted to provide solutions to many real problems found in the design of roller applicator handles and from the absence of their commercial success that there is indeed a problem to be solved and that the solutions offered heretofore have not been widely accepted in the art.

It is against the background of this prior art and the shortcomings thereof that the novelty and simplicity of the instant invention can be appreciated. The out of plane grip axis set at the angles taught by this invention used in conjunction with a substantially rigid rod handle in conjunction with a conventional roller or roller sleeve and being manufacturable using presently used materials and equipment, is not found in the prior art. While many of the elements of this invention are found in the prior art, the prior art does not employ these elements in the way in which the present invention does and the prior art does not satisfactorily achieve the ends achieved by the present invention.

BRIEF DESCRIPTION OF THE INVENTION

Briefly stated the invention is a handle for roller applicators which enables the standing user to hold the roller against a wall with the roller axis substantially vertical and to stroke horizontally at heights on the wall at which horizontal stroking would be difficult if not impossible to achieve by a standing user when using a roller having a conventional handle.

The geometry of the handle is such that the longitudinal axis of the grip portion of the handle is skewed to the axis of rotation of the roller portion of the handle in such a way that the common perpendicular between the two skewed axes intersects the axis of rotation of the roller near the location where the handle enters the roller and the common perpendicular is at least 2 inches long and the angle between the two skewed lines is between 20° and 40° with 30° being the preferred angle.

BRIEF DESCRIPTION OF THE DRAWINGS

FIG. 5 is a plane view of a second embodiment of the invention.

FIG. 6 is a front elevational view of the embodiment of FIG. 5.

FIG. 7 is a side elevational view of the embodiment of FIG. 5.

FIG. 8 is an auxiliary view showing the true angle between the longitudinal axis of the grip and the axis of rotation of the roller.

DETAILED DESCRIPTION OF THE DRAWINGS

Figure 2:
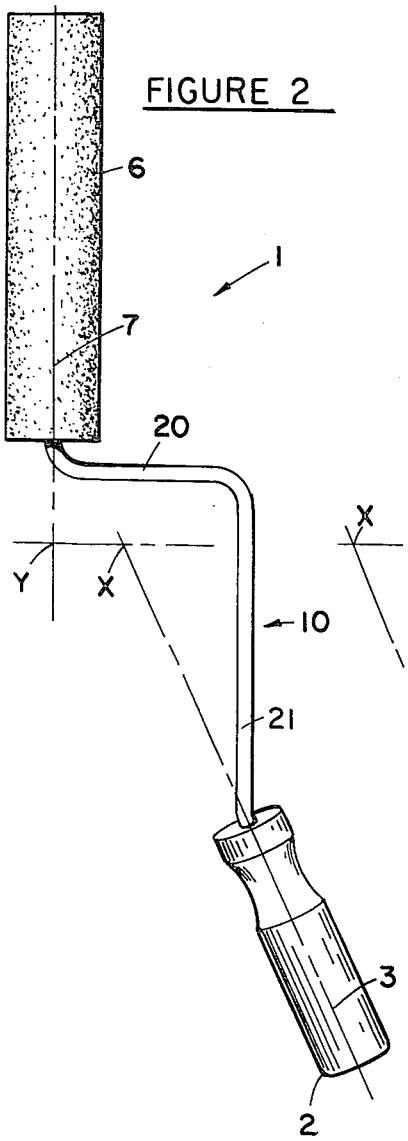
FIG. 2 is a front elevational view of the handle of FIG. 1.
Figure 1:
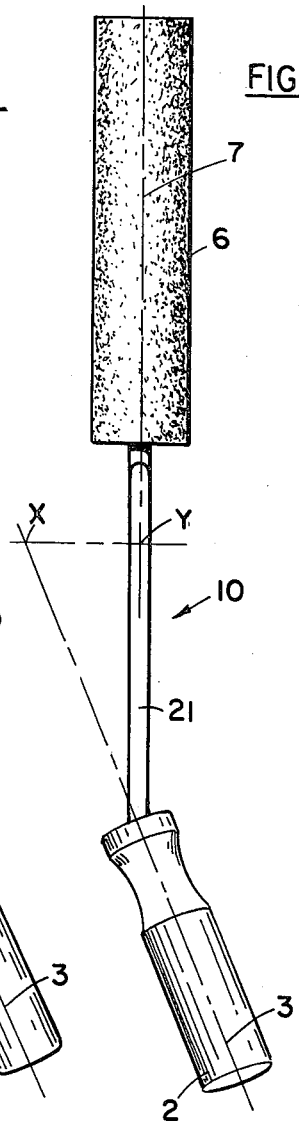
FIG. 1 is a plane view of a preferred embodiment of the handle of this invention.
Figure 4:
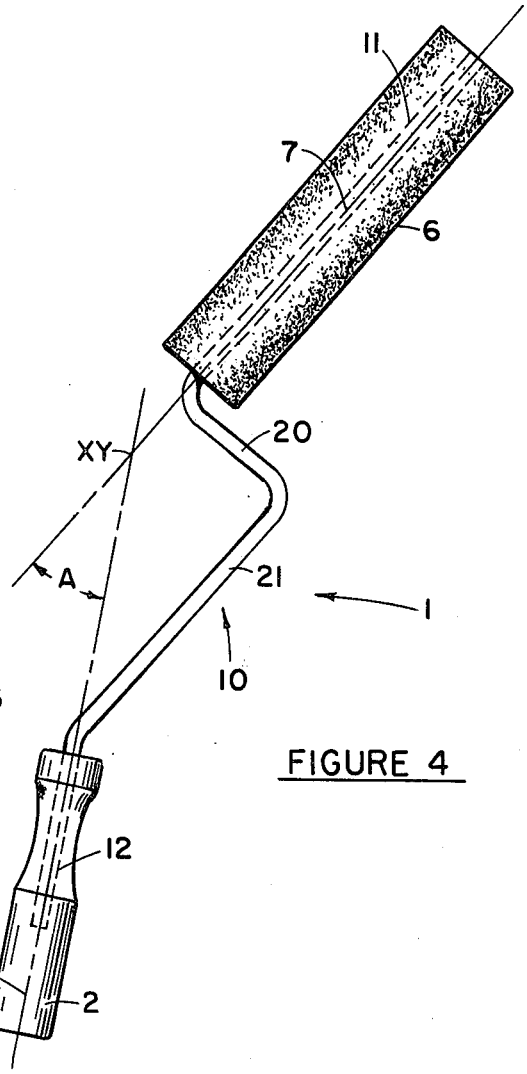
FIG. 4 is an auxiliary view of the handle of FIG. 1 showing the true angle between the axis of the grip and the axis of rotation of the roller.
Figure 3:
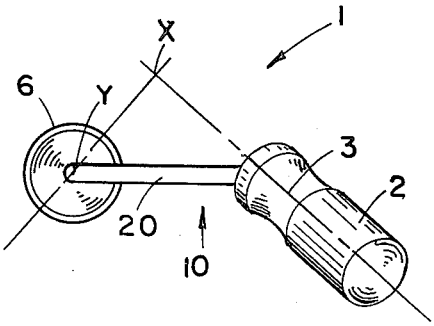
FIG. 3 is a side elevational view of the handle of FIG. 1.

Referring now to FIGS. 1 through 4. Applicator 1 has a grip 2 having longitudinal axis 3 and a roller 6 having axis of rotation 7. Handle 10 is formed from solid steel rod material which is in the order of $\frac{1}{4}$ to $\frac{3}{8}$ inches in diameter. Under the work loads ordinarily encountered in use, handle 10 can be considered to be rigid. Handle 10 is terminated at one end by roller axial 11 and by grip axis 12 (shown dashed in FIG. 4) at the other end. FIG. 4 shows the true length of grip axis 3 and roller axis 7 and therefore the true angle-A between them. Angle-A is an angle between 20° and 40° with the preferred angle being 30°. Line XY is the common perpendicular between axis 3 and axis 7. XY intersects axis of rotation 7 of roller 6 near the point where handle 10 enters roller 6. Line XY is preferably greater than 2 inches long.

It is possible to construct handle 10 by forming axis 3 and axis 7 at the preferred angle to each other and having line XY as the transition from axis 3 to axis 7. This configuration is not preferred in that the balance of applicator 1 is diminished by such a construction and the intersection of line XY and axis 3 interferes with some types of roller strokes. It is preferred to provide the handle with an upright segment 20 and a joining segment 21.

The angle between axis 3 and axis 7 and the length of line XY have a limited range of variability in which the handle will serve satisfactorily. However, because of the range of variance in human physiology an individual may wish to alter the angle between the axes within the range specified above. This alteration may be achieved by using rod bending tools. Thus it is seen that while handle 10 is substantially rigid in use, it may be adjusted within the range of useful angles and distances specified above.

In use, when executing horizontal strokes with applicator 10 at levels on a wall at which horizontal strokes would be difficult or impossible to execute by a user standing on the floor, it has been observed that a stroke in one direction frequently involves both the pushing and pulling of the roller along the wall and a transition between the pushing and pulling. In counter distinction, when an applicator having a conventional handle is used to execute horizontal strokes, the user faces in one direction and pushes the applicator in one direction and pulls it in the other direction. It is believed that it is the pushing and pulling in the same direction of stroke and the need to maintain even roller pressure while making a smooth transition from pushing to pulling in a single stroke that brings about the need to skew the axis 3 and axis 7 and to have their common perpendicular at least 2 inches long and that the common perpendicular intersects axis 7 near the location where axis 7 enters roller 6.

This belief is reinforced by the embodiment of FIGS. 5 through 8 wherein the shape of the applicator is quite different from that of FIGS. 1 through 4 but the critical parameters are not only consistent with but are the same as the critical parameters of FIGS. 1 through 4. That is that the axis of rotation of the roller be skewed to the longitudinal axis of the grip at an angle between 20° and 40° with 30° being preferred and that the common perpendicular between the two axes be at least 2 inches long and that the common perpendicular between the two axes intersect the axis of rotation of the roller near the point where the axis enters the roller.

Referring now to the embodiment of FIGS. 5 through 8. Applicator 51 has handle 60 which is terminated at one end by the rotation axis 67 of roller 66 and at the other end by the longitudinal axis 63 of grip 62 (shown dashed in FIG. 8) and axis 67 is joined to axis 63 by upright segment 70 which extends from rotational axis 67 to joining segment 71 which intersects axis 63 of grip 12 as shown.

The embodiment of FIGS. 5 through 8 may serve substantially the same purposes as the embodiment of FIGS. 1 through 4. It has the added utility of permitting the use of an extension handle to enable a standing user to execute a horizontal stroke on a surface below the level of his feet such as painting an outside wall while standing and reaching over a parapet as illustrated in FIG. 10.

Figure 9:
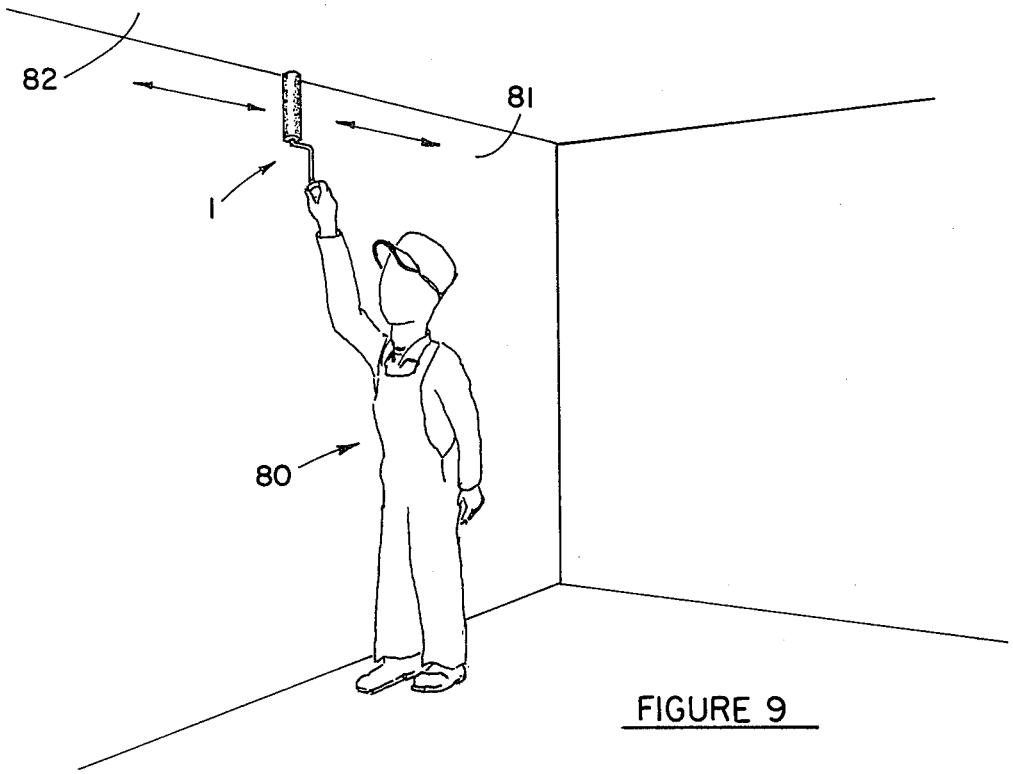
FIG. 9 is a pictorial view of the embodiment of FIGS. 1 through 4 being used to paint a wall above the head of a standing user.

Referring now to FIG. 9. Standing user 80 is shown executing horizontal strokes with applicator 1 on wall 81 at an elevation on wall 81 near ceiling 82.

Figure 10:
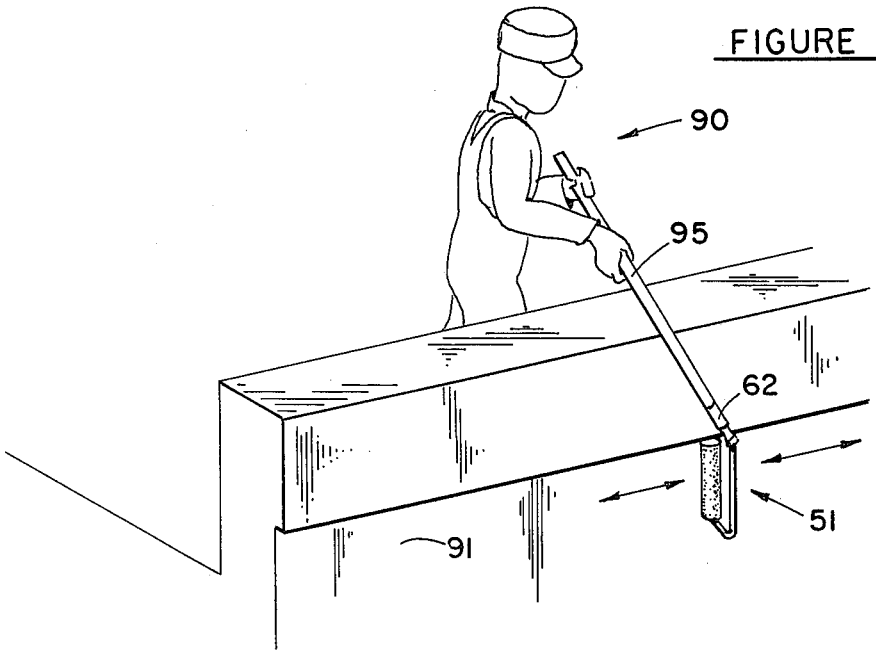
FIG. 10 is a pictorial view of the embodiment of FIGS. 5 through 8 as it may be used in conjunction with a handle extension to paint a wall below a users feet.

Referring now to FIG. 10. User 90 is shown executing horizontal strokes with applicator 51 on wall 91 at an elevation on wall 91 which is below the feet of the user by employing extension 95 which is joined to grip 62 of applicator 51. Extension 95 may be joined with grip 62 by any conventional means such as a threaded attachment or the like. Applicator 51 permits the execution of horizontal strokes with a roller applicator in situations such as that illustrated in FIG. 10 the achievement of which heretofore required the use of platforms or scaffolding.

It should be recognized that the embodiments disclosed herein are intended for use by right handed users. Embodiments for left handed users may be achieved by bending the handle to provide mirror images of the disclosed shapes.

Two embodiments of the invention have been disclosed herein and the ranges of certain critical dimensions have been specified. However, it should be understood that the scope of the invention should be only limited by the appended claims and all equivalents thereto which would become readily apparent to one skilled in the art.

I claim:

1. A handle for a roller applicator comprising; a single solid metal rod in the order of $\frac{1}{4}$ inch in diameter and having a roller axis segment at one end of the rod and a longitudinal grip axis segment at the other end of the rod and the rod is bent to form a handle such that the roller axis is in a skewed relationship to the grip axis at an angle of between 20° and 40° and the common perpendicular between the grip axis and the roller axis is greater than 2 inches long and the point of intersection between said common perpendicular and the roller axis is near the location where the roller axis enters a roller.

2. The handle of claim 1 wherein the rod is bent at substantially 90° to the roller axis segment to form an upright segment which is longer than the common perpendicular between the roller axis and the grip axis and the upright segment is joined to the grip axis segment by means of a joining segment.

3. The handle of claim 2 wherein the joining segment projects in substantially the opposite direction from the upright segment as does the roller axis segment.

4. The handle of claim 2 wherein the joining segment projects in the same general direction from the upright segment as does the roller axis segment.

* * * * *